US006142431A

United States Patent [19]

Herzog

[11] Patent Number: 6,142,431

[45] Date of Patent: Nov. 7, 2000

[54] FURNITURE LEVELING FOOT AND SYSTEM

[75] Inventor: Richard R. Herzog, Arlington Heights, Ill.

[73] Assignee: Illinois Tool Works Inc., Glenview, Ill.

[21] Appl. No.: 09/175,867

[22] Filed: Oct. 20, 1998

[51] Int. Cl.[7] ..... F16M 11/24

[52] U.S. Cl. ..... 248/188.4

[58] Field of Search ..... 248/188.4, 188.2, 248/188.9, 650, 649, 677, 634, 632, 615, 616, 638, 354.3; 411/528, 437, 423, 411; 135/86, 82

[56] References Cited

PUBLICATIONS

American National Standard ANSI/BIFMA X5.5, 1989, pp. 10–19.

*Primary Examiner*—Ramon O. Ramirez

*Attorney, Agent, or Firm*—Schwartz & Weinrieb

[57] ABSTRACT

A furniture leveling foot and system therefor includes a threaded shaft with a lead end portion, and a foot end portion having a resilient head with a curved flange portion curving generally radially outwardly from the threaded shaft with increasing axial distance from the foot end portion thereof, whereby the head is flexible so as to absorb impact shock directed toward the threaded shaft. The threaded shaft has screw threads disposed helically thereabout, and the screw threads have a leading side configured at an angle. An opening disposed through a plate member has a partially circumferential helical edge defined by a helical surface portion having an outer surface at an angle equal to the angle of the leading side of the screw thread. The lead end portion of the threaded shaft is rotatably disposable in the opening of the plate member from the second side thereof by engaging the screw threads with the helical edge. The helical surface portion of the plate member is engageable with a surface area of the leading side of the screw thread to provide support.

24 Claims, 4 Drawing Sheets

FURNITURE LEVELING FOOT AND SYSTEM

FIELD OF THE INVENTION

The present invention relates generally to adjustable leveling feet, and more particularly to threaded leveling feet and systems therefor useable for supporting and leveling furniture, including metal desks and file cabinets.

BACKGROUND OF THE INVENTION

Threaded leveling feet are known and used widely for supporting and leveling furniture and appliances. FIG. 7 of the present application, for example, illustrates a known prior art leveling foot used commonly in metal cabinetry, desks, and other furniture applications. The prior art leveling foot of FIG. 7 comprises generally a head member 3 coupled to a threaded shaft 5 adjustably disposed through a weld nut or other threaded member 7, which is welded or otherwise fastened directly on an underside 9 of the furnishing supported thereby.

The prior art leveling foot of FIG. 7 however is relatively rigid, and has a tendency to damage furniture during handling and moving thereof. More particularly, compressive loads applied axially along the threaded shaft 5 impart forces to the furniture that tend to cause buckling thereof, for example along the sides and corners of metal desks and file cabinets. Also, shear forces applied transversely to the threaded shaft 5 tend to bend the shaft or the underside 9 of the furniture, sometimes separating the weld nut 7 from the furniture, and often deforming outer side portions thereof.

The furniture industry has adopted general standards or guidelines against which leveling foot performance is evaluated. These guidelines include the American National Standard ANSI/BIFMA drop test and leg strength, or shear, test and apply generally to furniture, including metal desks and file cabinets, that is moved frequently. The relatively rigid prior art leveling foot of FIG. 7, and other similar supports, however, are relatively susceptible to damage that may render the furniture unserviceable as defined by industry standards.

The prior art leveling foot of FIG. 7 is also relatively costly to manufacture and install. The head member 3 may be formed, for example in a stamping operation, and then fastened to the threaded shaft 5, for example by welding or by staking. The bore, or hole, in the furniture underside 9 that accommodates the weld nut 7 is fabricated generally by a drilling or stamping operation, and where the underside 9 is recessed to accommodate the weld nut 7 as in FIG. 7, additional tooling or forming operations are required. Thereafter the weld nut 7 is welded or otherwise fastened to the underside 9 of the furniture.

The prior art leveling foot of FIG. 7 is most often formed of metal, which has a tendency to oxidize and become unsightly. Over time, oxidation may interfere with or prevent adjustment of the leveling foot, and may ultimately degrade the structural integrity thereof. To address these problems, the metal may be treated or coated, but this further increases costs, which is undesirable.

It is also known generally in the appliance industry to fabricate leveling feet from plastic materials, as illustrated in prior art FIG. 8 of the present application. The appliance industry has however adopted different test standards for leveling feet than the furniture industry, since appliances like washing and drying machines and kitchen ranges tend to be relatively stationary after installation and are not moved about as frequently as is furniture. FIG. 8 illustrates a known prior art appliance industry plastic leveling foot having a relatively thick threaded shaft 11 with an acme or an American national screw thread adjustably disposed through a threaded opening in an underside 13 of the appliance.

The known plastic leveling feet of the appliance industry are relatively rigid, and have a tendency to break and cause damage to the appliance when subject to compressive and shear forces, as discussed above regarding the prior art leveling foot of FIG. 7. Known prior art plastic appliance leveling feet may also have a relatively square corner 12 between the bottom surface of the foot member and the sides thereof. The foot and particularly the square corner thereof tends to be obstructed easily by floorings having discontinuous surfaces, typical of some tile floorings, which may cause the threaded shaft 11 to break or cause damage to the underside 13 of the appliance when subject to excessive shear forces.

FIG. 8 also illustrates a prior art threaded screw opening characterized generally by an upper lip portion 14 and a lower lip portion 15 formed for example in a stamping operation. The known prior art stamped threaded openings typical of the appliance industry generally reduce costs associated with fastening a nut thereto by welding, but the stamped threads tend to concentrate the load unduly on portions of the threaded shaft, which has a tendency to fail. Prior art stamped threaded openings tend also not to distribute the load evenly about the threaded shaft, producing greater loads on one side of the shaft than on the other side thereof. FIGS. 8 and 9 illustrate an edge 16 of the lower lip portion 15 imparting most all of the forces to the threaded shaft 11 along a line portion on a surface 18 thereof extending only partially thereabout. This concentrated load renders the threaded shaft 11 highly susceptible to failure, particularly on the side thereof where the load is applied. Not surprisingly, prior art plastic leveling feet and the stamped threaded openings of the appliance industry perform unacceptably when subject to compressive and shear loads characteristic of the furniture industry.

The present invention is drawn toward advancements in the art of leveling feet, and more particularly to threaded leveling feet for supporting and leveling furniture, including metal desks and file cabinets, and systems therefor.

It is an object of the invention to provide novel leveling feet and systems therefor that are economical and that overcome problems in the prior art.

It is another object of the invention to provide novel leveling feet and systems therefor that are relatively strong and reliable, and more particularly leveling feet and systems therefor that better comply with furniture industry standards.

It is also an object of the invention to provide novel leveling feet that better absorb impact shock thereto thereby reducing shock loads imparted to the article supported thereby, and to provide leveling foot systems that better distribute loads relatively uniformly and over relatively large surface areas.

It is a more particular object of the invention to provide novel leveling feet, useable for supporting and leveling furniture and other articles, comprising generally a threaded shaft having a lead end portion and a resilient head disposed on a foot end portion thereof, the head having a curved flange portion curving generally radially outwardly from the threaded shaft with increasing axial distance from the foot end portion thereof, whereby the head is relatively flexible to absorb impact shock directed toward the threaded shaft.

It is a more particular object of the invention to provide novel leveling feet systems, useable for supporting and leveling furniture and other articles, comprising generally a leveling foot having a threaded shaft with a lead end portion, and a foot end portion with a head. The threaded shaft has screw threads disposed helically thereabout, and the screw threads have a leading side configured at an angle. An opening disposed through a plate member has a partially circumferential helical edge extending helically from a first side thereof. The helical edge is defined by a helical surface portion of the plate member having an outer surface at an angle substantially equal to the angle of the leading side of the screw thread, and disposed at least partially about the opening. The lead end portion of the threaded shaft is disposable into and partially through the opening of the furniture plate member from the second side thereof by rotatably engaging the screw threads with the helical edge, and the helical surface portion of the furniture plate member is engageable with a surface area of the leading side of the screw thread to support the article.

BRIEF DESCRIPTION OF THE DRAWINGS

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators, and wherein:

BRIEF DESCRIPTION OF THE DRAWINGS

Figure 1:
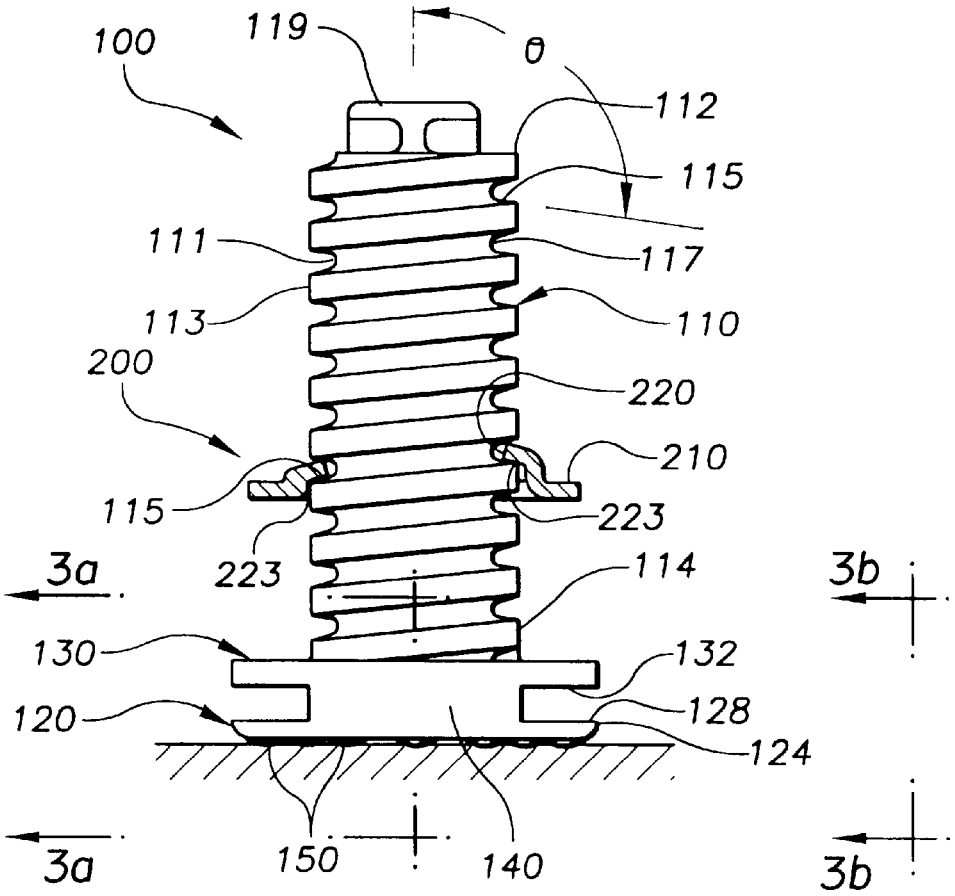

FIG. 1 is a side view of a leveling foot and a stamped threaded opening according to an exemplary embodiment of the invention.

Figure 2:
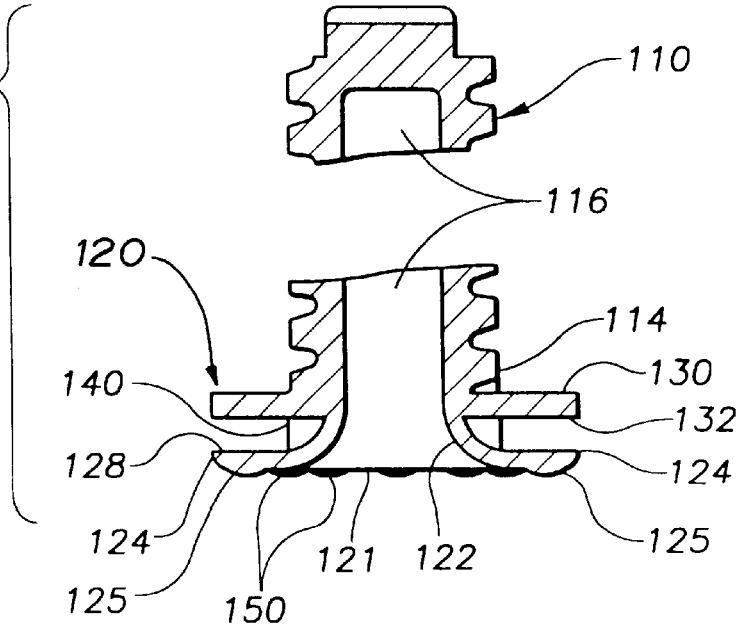

FIG. 2 is a partial sectional view of a leveling foot according to an exemplary embodiment of the invention.

Figure 3A:
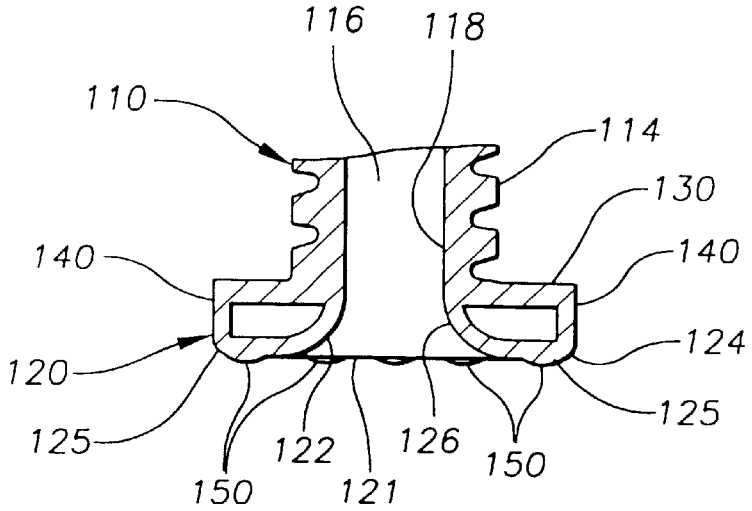

FIG. 3*a* is a partial sectional view along lines 3*a*—3*a* of FIG. 1.

Figure 3B:
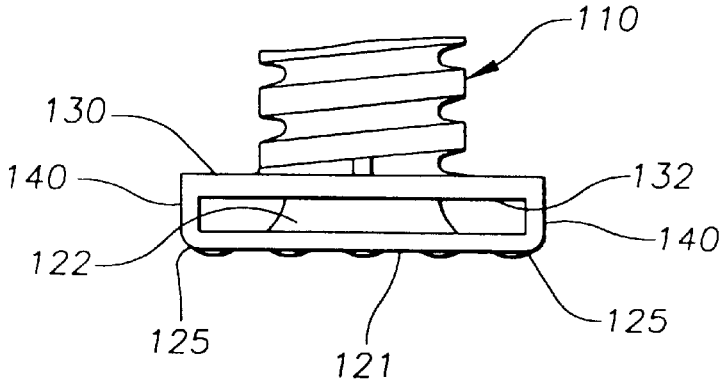

FIG. 3*b* is a partial side view along lines 3*b*—3*b* of FIG. 1.

Figure 4:
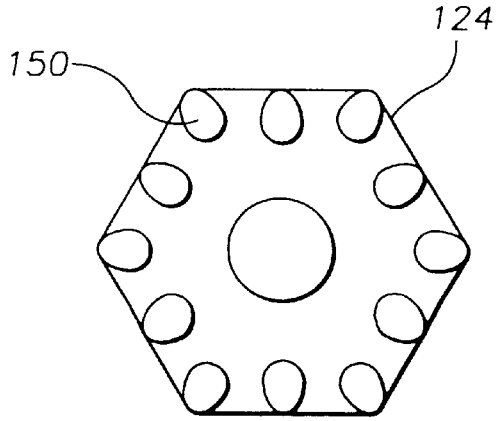

FIG. 4 is an end view of a foot portion of an exemplary leveling foot.

Figure 5:
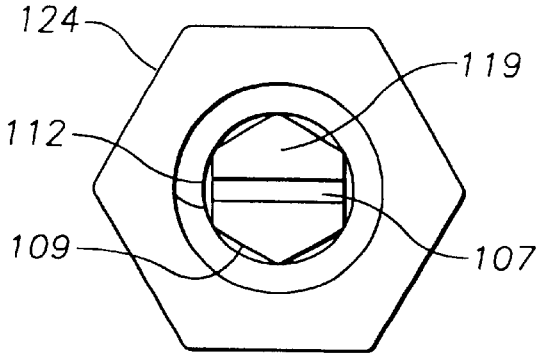

FIG. 5 is an end view of a threaded shaft portion of an exemplary leveling foot.

Figure 6A:
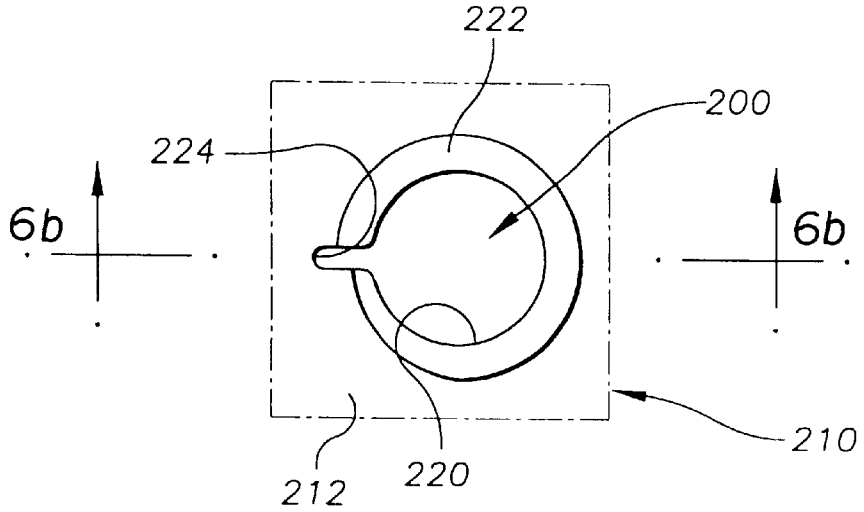

FIG. 6*a* is a top plan view of a stamped threaded opening according to an exemplary embodiment of the invention.

Figure 6B:
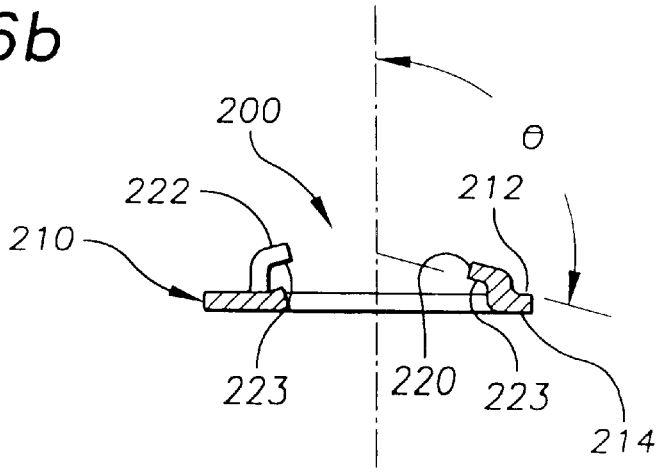

FIG. 6*b* is a partial sectional view along lines 6*b*—6*b* of FIG. 6*a*.

Figure 7:
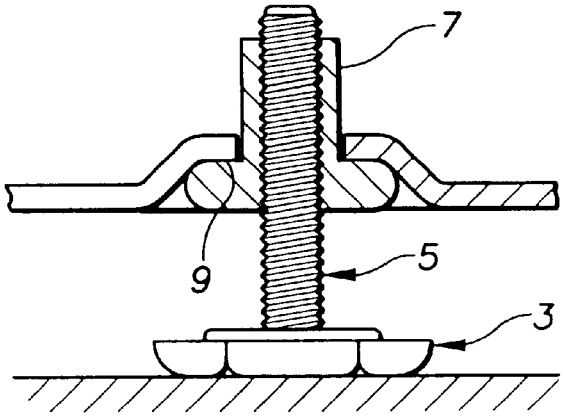
FIG. 7 PRIOR ART

FIG. 7 is a prior art furniture leveling foot.

Figure 8:
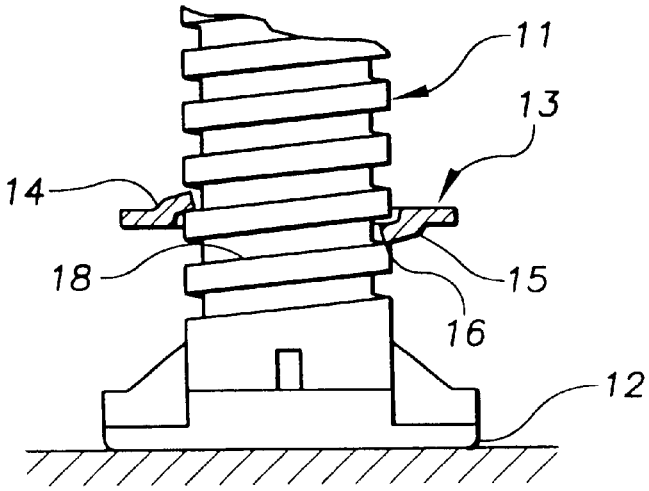
FIG. 8 PRIOR ART

FIG. 8 is a prior art appliance leveling foot.

Figure 9:
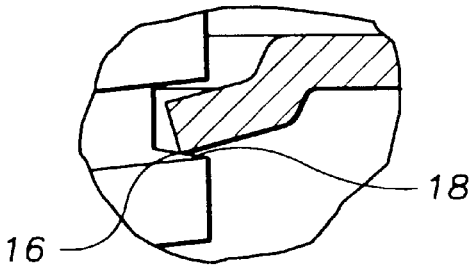
FIG. 9 PRIOR ART

FIG. 9 is an enlarged view of a portion of FIG. 8.

DETAILED DESCRIPTION OF THE INVENTION

FIG. 1 is a system for leveling furniture including metal desks and file cabinets among other furnishing articles, and particularly furniture that is moved about frequently. The system comprises generally a leveling foot 100 adjustably engageable with a threaded opening 200 of the furnishing to support and level the furnishing, as discussed further below. In a typical application, a plurality of leveling feet are adjustably engaged with corresponding threaded openings on the underside of the furnishing, for example in each or four corners thereof, or on opposing sides along a front end thereof where the leveling feet are readily accessible.

FIG. 1 illustrates the leveling foot 100 having a threaded shaft 110 including screw threads disposed helically thereabout along a portion of an axial dimension thereof. The screw threads have an inner diameter 111 and an outer diameter 113, and preferably a continuously curved radius 117 between adjacent threads at the inner diameter thereof. The continuously curved radius 117 is less susceptible to fracture under load than are the sharp angular interfaces between the various surfaces of the threaded shaft of known prior art appliance leveling feet illustrated in FIG. 8. The screw threads also have a leading side 115 at an angle θ measured therefrom to the axial dimension of the threaded shaft 110.

The threaded shaft 110 includes a lead end portion 112 and a head 120 disposed on a foot end portion 114 thereof. FIGS. 2, 3*a* and 3*b* illustrate the head 120 having a generally curved funnel shape. The head 120 has, more particularly, a curved flange portion 122 curving generally radially outwardly from the threaded shaft 110 with increasing axial distance from the foot end portion 114 thereof, wherein the curved flange portion 122 includes an outer end 124 terminating radially outwardly of the threaded shaft 110.

The leveling foot 100, and at least the head 120 thereof is formed of a resilient material, whereby the head 120 is flexible to absorb impact shock thereto, especially impact shock directed axially and radially toward the threaded shaft 110. The generally curved funnel shaped head 120 formed of a resilient material is flexible thereby generally absorbing impact shock resulting from axial and shear forces applied thereto. The leveling foot 100 thus substantially reduces the forces transmitted to the threaded shaft and to the furnishing, thereby substantially reducing the possibility of damage to the furniture. Also, the leveling foot 100 of the present invention complies better with furniture industry drop and shear test standards.

The leveling foot 100, and more particularly, the threaded shaft 110 and the head 120 thereof are formed preferably as a unitary member, or a single piece, for example in a molding operation. In one embodiment suitable for furnishing applications, the threaded shaft 110 and the head 120 are formed unitarily of a nylon or other suitably resilient material.

FIGS. 2 and 3*a* illustrate the threaded shaft 110 having a hollow core 116 with an inner cylindrical surface 118 proximate the foot end portion 114 thereof, and preferably extending toward the lead end 112 thereof. In FIG. 3*a*, the head 120, and more particularly the curved flange portion 122 thereof has a curved lower surface portion 126 extending substantially continuously from the inner cylindrical surface 118 of the threaded shaft core 116 toward the outer end 124 of the curved flange portion 122. The hollow core 116 reduces weight of the leveling foot 100 without adversely compromising the strength thereof, and also reduces molding cycling time by reducing the cooling period after molding, thereby increasing the productivity of molding operations. The continuous interface between the curved lower surface portion 126 and the inner cylindrical surface 118 eliminates any discontinuous regions that may be susceptible to failure, thereby generally increasing the strength and durability of the leveling foot 100.

FIGS. 1, 2, 3*a* and 3*b* illustrate a second flange 130 extending radially outwardly from the foot end portion 114 of the threaded shaft 110, and a support member 140 disposed between an upper surface 128 of the curved flange portion 122 and a lower surface 132 of the second radial flange 130. Preferably, at least two support members 140 interconnect the curved flange portion 122 and the second flange 130, although in other embodiments additional support members may be disposed therebetween. The support members 140 and the second flange 130 are also formed of a resilient material, and are formed preferably unitarily with the threaded shaft 110 and the head 120, for example in a molding operation, as discussed above. The support members 140 transmit forces from the curved flange portion 122 to the second flange 130, which also flexes to absorb impact shock, thereby further reducing forces transmitted to the threaded shaft and to the furnishing.

FIGS. 1, 2, 3*a* and 4 illustrate a plurality of dimples 150 disposed on a lower surface portion of the head 120 and arranged generally annularly proximate the outer end 124 of the curved flange portion 122. Depending on the application, the dimples 150 are configured to increase or decrease contact area with the underlying flooring thereby providing means for controlling the ease or difficultly with which the leveling foot 100 slides thereacross. In some applications, for example on harder and flatter floors, it may be desirable to increase frictional contact therewith, whereas in other applications it may be desirable to reduce frictional contact with the flooring, for example on carpeted floors. The dimples 150 are also formed of a resilient material, and are formed preferably unitarily with the head 120 and the threaded shaft 110, for example in a molding operation, as discussed above.

FIGS. 2, 3*a* and 3*b* also illustrate the head 120 having a curved surface 125 between the outer end 124 of the curved flange portion 122 and a lower surface portion 121 thereof. In the exemplary embodiment, the radius of curvature of the dimples 150 defines the curved surface 125, although in other embodiments the curved surface 125 may be defined by forming a bevel at an angle between the outer end 124 and the lower surface portion 121. The curved surface 125 facilitates sliding of the leveling 100 foot over flooring by providing a surface that traverses discontinuities in the flooring more readily than the relatively sharp right angle corners in known prior art appliance leveling feet. The curved surface 125 substantially reduces the possibility of applying excessive shear forces to the threaded shaft 110 and thus reduces the possibility of damage thereto and to the furnishing.

FIGS. 4 and 5 illustrate the outer end 124 of the leveling foot 100 having a hexagonal shape, which may be useful for applying an adjustment torque to the leveling foot previously installed in an opening 200, where only the head 120 is accessible. FIG. 5 illustrates the lead end portion 112 of the threaded shaft 110 having an adjustment member on a tip portion 119 thereof for adjusting the leveling foot 100 from above, which may be desirable in other applications. In the exemplary embodiment, the adjustment member is a standard screw driver slot 107 and a hexagonal surface 109, either one of which may be used to adjust the leveling foot 100.

FIGS. 6*a* and 6*b* illustrate the threaded opening 200 disposed through a furniture plate member 210, for example a metal plate portion of a metal desk or file cabinet. The plate thickness ranges typically between approximately 16 gauge and approximately 18 gauge metal thickness, although this thickness range is only exemplary and is not intended to limit the invention, since the plate thickness may be more or less depending on the strength requirements of each particular application.

The opening 200 has an opening diameter between the inner diameter 111 and the outer diameter 113 of the screw threads formed on the threaded shaft 110, discussed above. The opening 200 has a partially circumferential helical edge 220 extending helically from a first side 212 of the plate member 210. The helical edge 220 is formed on only the one side of the furniture plate member, which is the first side 212 thereof in the exemplary embodiment. The helical edge 220 is defined by a helical surface portion 222 of the plate member disposed at least partially about the opening 200. The helical surface portion 222 is also formed on the first side 212 of the plate member and has an outer surface 223 configured at an angle substantially equal to the first angle θ of the leading side 115 of the screw thread. The helical surface portion 222 is formed, for example in a stamping operation that deforms material of the plate member from the second side 214 thereof.

The lead end portion 112 of the threaded shaft 110 is disposable into and partially through the opening 200 of the furniture plate member 210 from the second side 214 thereof by engaging the screw threads with the helical edge 220 to adjustably position the threaded shaft 110 through the opening, as illustrated in FIG. 1. Thus engaged, a surface area of the outer surface 223 is engageable with a support surface area of the leading side 115 of the screw thread, thereby increasing the distribution of the load supported by the leveling foot 100 over a relatively large area.

FIG. 6*a* illustrates the helical edge 220 and the helical surface portion 222 having a circumference of nearly 360 degrees, except for a curved cut out portion 224, which is a necessary relief to form the helix. The helical edge 220 and helical surface 222 are formed on only the one side of the furniture plate member, which is the first side 212 in the exemplary embodiment, to provide a supporting surface engageable with the threaded shaft and extending nearly 360 degrees thereabout, except for the curved cut out portion 224, thereby further distributing weight over a larger support surface area extending nearly fully about the threaded shaft. This is a substantial improvement over known prior art appliance threaded openings having a lower lip portion with an edge that engages the threaded shaft over a significantly smaller surface area on only one side thereof partially thereabout, as discussed above and illustrated in prior art FIGS. 8 and 9.

In the present invention, the angle θ of the outer surface 223 of the helical surface portion 222 is substantially equal to the first angle θ of the leading side 115 of the screw thread, as illustrated in FIGS. 1 and 6*b*, thereby providing a relatively large support surface area that is engageable with the threaded shaft 110 supporting the furniture. The load supporting surface or interface between the plate member 210 and the threaded shaft 110 extends nearly fully about the threaded shaft, thereby substantially reducing the concentration of the load applied to the leveling foot 100 in comparison to the high loads applied to the known prior art appliance leveling foot of FIGS. 8 and 9. In the present invention therefore the concentration of forces applied to the leveling foot 100 by the plate member 210 is reduced substantially thereby contributing to the robustness and reliability of the leveling foot and significantly improving the performance thereof over the prior art.

While the foregoing written description of the invention enables one of ordinary skill to make and use what is considered presently to be the best mode thereof, those of ordinary skill will appreciate and understand the existence of variations, combinations, and equivalents of the specific exemplary embodiments herein. The invention is therefore to be limited not by the exemplary embodiments, but by all embodiments within the scope and spirit of the appended claims.

What is claimed is:

1. A leveling foot useable for supporting and leveling furniture, comprising:

a threaded shaft having an axial dimension with a lead end portion and a foot end portion;

a head disposed upon the foot end portion of the threaded shaft, the head having a first curved flange portion curving generally radially outwardly from the threaded shaft with increasing axial distance from the foot end portion thereof, the curved flange portion having an outer end terminating radially outwardly of the threaded shaft;

at least the head of the leveling foot being formed of a resilient material, whereby the head is flexible so as to absorb impact shock directed toward the threaded shaft;

a second flange portion extending radially outwardly from the foot end portion of the threaded shaft; and at least two support members disposed between an upper surface portion of said first curved flange portion and a lower surface portion of said second flange portion.

2. The leveling foot of claim 1 further comprising the threaded shaft having a hollow core with an inner cylindrical surface proximate the foot end portion thereof, the head having a curved lower surface portion extending continuously from the inner cylindrical surface of the threaded shaft toward the outer end of the curved flange portion.

3. The leveling foot as set forth in claim 1, wherein:

said at least two support members interconnect radially outer portions of the first and second flange portions.

4. The leveling foot of claim 1 further comprising a plurality of dimples disposed on a lower surface portion of the head and arranged generally annularly proximate the outer end of the curved flange portion.

5. The leveling foot of claim 1 further comprising a curved surface between the outer end of the curved flange portion and a lower surface portion of the head.

6. The leveling foot of claim 1 further comprising the threaded shaft having an inner diameter and an outer diameter, the inner diameter having a continuously curved radius between threads of the threaded shaft.

7. The leveling foot of claim 1 further comprising the outer end of the curved flange portion having a hexagonal shape.

8. The leveling foot of claim 1 further comprising an adjustment member on the lead end portion of the threaded shaft.

9. The leveling foot as set forth in claim 8, wherein:

said adjustment member comprises a slot for receiving a torquing tool.

10. The leveling foot as set forth in claim 8, wherein:

said adjustment member comprises a hexagonally shaped tip portion of said lead end portion of said threaded shaft.

11. The leveling foot of claim 1 further comprising the threaded shaft and the head formed as a unitary member from a resilient material.

12. The leveling foot as set forth in claim 8, wherein:

said resilient material comprises nylon.

13. The leveling foot as set forth in claim 1, wherein:

said at least two support members interconnect radially inner portions of the first and second flange portions.

14. A system for leveling furniture, comprising:

a furniture plate member;

a leveling foot having a threaded shaft with an axial dimension;

the threaded shaft having a lead end portion, a foot end portion with a head, and screw threads disposed helically thereabout, the screw threads having an inner diameter and an outer diameter, the screw threads having a leading side at an angle;

an opening disposed through said furniture plate member, the opening having an opening diameter between the inner and outer diameters of the screw threads, the opening having a partially circumferential helical edge extending helically from a first side of the furniture plate member;

the helical edge defined by a helical surface portion of the furniture plate member disposed at least partially about the opening, the helical surface portion having an outer surface at an angle substantially equal to the angle of the leading side of the screw thread;

the lead end portion of the threaded shaft being rotatably disposable into the opening of the furniture plate member from a second side thereof by rotatably engaging the screw threads with the helical edge;

the helical surface portion of the furniture plate member being engageable with a surface area of the leading side of the screw thread;

the head on the foot end portion of the threaded shaft having a first curved flange portion curving generally radially outwardly from the threaded shaft with increasing axial distance from the foot end portion thereof, the curved flange portion having an outer end terminating radially outwardly of the threaded shaft;

at least the head of the leveling foot being formed of a resilient material, whereby the head is flexible so as to absorb impact shock directed toward the threaded shaft;

a second flange portion extending radially outwardly from the foot end portion of the threaded shaft; and at least two support members disposed between an upper surface portion of said first curved flange portion and a lower surface portion of said second flange portion.

15. The system of claim 14 further comprising the helical edge and the helical surface of the opening formed on only the first side of the furniture plate member.

16. The system of claim 14 further comprising the threaded shaft having a hollow core with an inner cylindrical surface proximate the foot end portion thereof, the head having a curved lower surface portion extending continuously from the inner cylindrical surface of the threaded shaft toward the outer end of the curved flange portion.

17. The system of claim 14 further comprising the helical edge having a circumference of nearly 360 degrees.

18. The system of claim 14 further comprising a plurality of dimples disposed on a lower surface portion of the head and arranged annularly proximate the outer end of the curved flange portion.

19. The system of claim 14, wherein:

the inner diameter of said screw threads of said threaded shaft comprises a continuously curved radius between adjacent threads of the threaded shaft.

20. The system of claim 14 further comprising the threaded shaft and the head formed as a unitary member of a resilient material.

21. The system as set forth in claim 20, wherein:

said resilient material comprises nylon.

22. The leveling foot as set forth in claim 14, wherein:

said threaded shaft comprises a hollow core with an inner cylindrical surface proximate the foot end portion thereof; and said head has a curved lower surface portion extending continuously from the inner cylindrical surface of the threaded shaft toward the outer end of the curved flange portion.

23. The system as set forth in claim 14, wherein:

said at least two support members interconnect radially inner portions of the first and second flange portions.

24. The system as set forth in claim 14, wherein:

said at least two support members interconnect radially outer portions of the first and second flange portions.

* * * * *